United States Patent [19]

Rabinow

[11] Patent Number: 4,599,877

[45] Date of Patent: Jul. 15, 1986

[54] KEY LOCK WITH KEY ISOLATION

[76] Inventor: Jacob Rabinow, 6920 Selkirk Dr., Bethesda, Md. 20817

[21] Appl. No.: 796,070

[22] Filed: Nov. 8, 1985

[51] Int. Cl.[4] ..... E05B 29/02

[52] U.S. Cl. ..... 70/366; 70/419

[58] Field of Search ..... 70/362, 365, 366, 423, 70/455, 419, 355, 420, 421, 353, 354

[56] References Cited

U.S. PATENT DOCUMENTS

| | | | |
|---|---|---|---|
| 180,255 | 7/1976 | Miller . | |
| 412,867 | 10/1889 | Williams | 70/423 |
| 412,997 | 10/1889 | Taylor | 70/353 |
| 473,857 | 4/1892 | Smith | 70/419 |
| 615,206 | 11/1898 | Babcock | 70/419 |
| 1,702,430 | 2/1929 | Fremon . | |
| 1,904,882 | 4/1933 | Prior, Jr. | 70/423 |
| 2,179,947 | 11/1939 | Miller . | |
| 2,528,964 | 11/1950 | Lurtz . | |
| 2,696,727 | 12/1954 | Schlabach | 70/421 |
| 3,172,283 | 3/1965 | Rabinow . | |
| 3,367,155 | 2/1968 | Kobrehel | 70/455 |
| 3,367,156 | 2/1968 | Johnstone | 70/455 |
| 4,111,019 | 9/1978 | Rabinow . | |
| 4,485,648 | 12/1984 | Rabinow . | |

FOREIGN PATENT DOCUMENTS

| | | | |
|---|---|---|---|
| 1133043 | 11/1968 | United Kingdom | 70/421 |

*Primary Examiner*—Gary L. Smith
*Assistant Examiner*—Suzanne L. Dino
*Attorney, Agent, or Firm*—Hall, Myers & Rose

[57] ABSTRACT

This specification describes a lock where a key sets a multiplicity of elements such as disks, levers or others. After setting the elements, the key and the key slot (through which the key enters the lock) is moved out of contact with the elements and is subsequently completely isolated from them. The fence or any other component that co-acts with the previously set elements to open the lock cannot be brought into contact with them until the above isolating action has been completed.

23 Claims, 27 Drawing Figures

KEY LOCK WITH KEY ISOLATION

BACKGROUND OF THE INVENTION

This invention relates to locks which have settable elements like disks, levers, or other forms of "tumblers" that can be set by a key.

Nearly all locks can be described, in a general sense, in the following way. They consist of an external memory which can be a key or a card or simply the intelligence of the operator. The lock is provided with an internal memory which can be set into coincidence with the external memory. There must be a provision by which the two memories can be made to interact. This can either be a slot in the lock through which a key can enter, or a slot for a card, or a dial or knobs to be operated manually by the user. In some recent technology, this interaction can even be a device that reads the fingerprint, the size of the user's hand, or any other arrangement of sensors that can connect the outside world to the inside memory of the lock.

The lock has a fourth major device that can detect the coincidence between the outside and inside memories. If the coincidence is correct, this fourth element permits the lock to open. This may be an electronic device that provides the proper signal, and it may be a mechanical component that permits a cylinder lock to turn, or a mechanical device that permits a bolt to be withdrawn.

It is obvious that locks can be defeated in one of two principal ways. The first is by brute force; that is, the lock can be broken, cut out, drilled, or otherwise damaged and neutralized. Some such techniques can be quite subtle in that a small hole can be drilled through which the internal mechanism can be examined and manipulated.

The second method for defeating a lock, and the problem addressed in this invention, is the general means called "picking" or surreptitious entry. In this approach, the lock is not damaged in any way, but by use of proper instruments coupled with skill of the operator, the internal mechanism can be manipulated and the lock opened.

In order to defeat this type of surreptitious entry, a great many expedients have been invented. Torque sensing devices, complicated keys, complicated tumblers and disks, time delay mechanisms, and a great many other techniques have been designed and produced. I myself have three patents on such expedients. They are U.S. Pat. Nos. 3,172,283; 4,111,019; and 4,485,648.

U.S. Pat. Nos. 2,528,964; 1,702,430 and 180,255 appear to be related to my subject invention. They discuss the principal idea of blocking the key slot before the lock can be opened. They do not, however, close the key slot completely or isolate the key from the tumblers. In one case, the key is made to have a wide flange and a rather narrow neck so that most of the key slot can be closed, but the passage to the tumblers from the outside world remains open although, as the patent clearly states, the passage is somewhat tortuous. In the others, the key slot is only partially closed.

U.S. Pat. No. 2,179,947 to S. Miller is much closer to the subject of my invention. Here a small key is inserted into the lock and is completely "swallowed" before it can be opened. The key slot is closed and the lock is turned by a handle. When the action of the lock is finished, the key is ejected from the lock. The disadvantages of having to use a key that cannot be conveniently carried as a ring or in a key case, that has a very small head, and that can get stuck in the lock because of dirt, congealed oil or a slight bend in the key, are too obvious to need further discussion.

SUMMARY OF THE INVENTION

My invention assumes that in a conventional key-operated lock, where the key sets a series of elements (such as disks, levers or other types of what are sometimes called tumblers), it is possible to reach the elements through the key slot and manipulate them while testing their position by torquing the cylinder or pushing back on the bolt or doing something equivalent. Admittedly, some locks are difficult to pick in this way because of the aforementioned efforts in designing the various components. Nevertheless, as long as there is access between the outside world and the control elements of the lock there is always the possibility of such manipulation. In the present invention, I have designed a system where the key sets the elements, as in conventional locks, but then the key and the key slot are moved away from the elements and are captured in what may be called an isolation compartment. The external world is then completely physically blocked from any connection between the key slot and the elements that control the opening of the lock. It is only after this has been accomplished and the physical opening to the lock is completely isolated from the internal memory that the fourth element of the lock, the fence or its equivalent, can test the position of the elements to see if they were correctly set.

In all of the embodiments, the interlock between the key space and the fence is such that the fence must be moved away from contact with the elements before the key slot can be turned back to its initial, open position. This motion also resets all the elements into their starting positions. They then have no relation to their positions for opening the lock.

DETAILED DESCRIPTION OF THE DRAWINGS

Figure 5A:
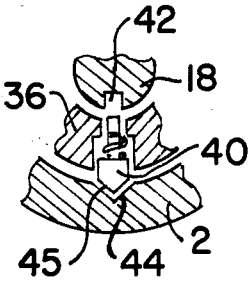
FIG. 5A shows a detail of the construction of a (detent) push-pin used in some of the embodiments.
Figure 5:
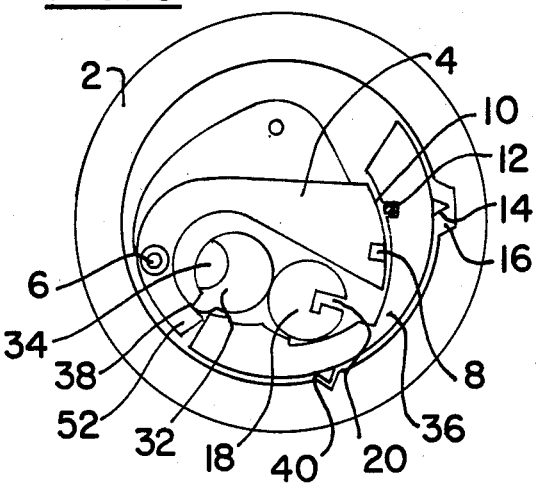
FIG. 5 is taken approximately on line 5—5 of FIG. 3, and shows the main components of the lock under the front face of the lock. The position of components is shown with the key slot in the initial position.

FIG. 5 shows a schematic diagram of the principal working elements of my invention. The lock consists of an outer case 2 which may be a cylinder containing the working parts. A multiplicity of levers 4 are pivoted at 6. Each lever has a notch 8 in the appropriate position for the lock to operate. Facing the working edges 10 of the levers 4 is a fence 12 operated by a push pin 14 the end of which is in a notch 16 in the outer casing 2.

Figure 1:
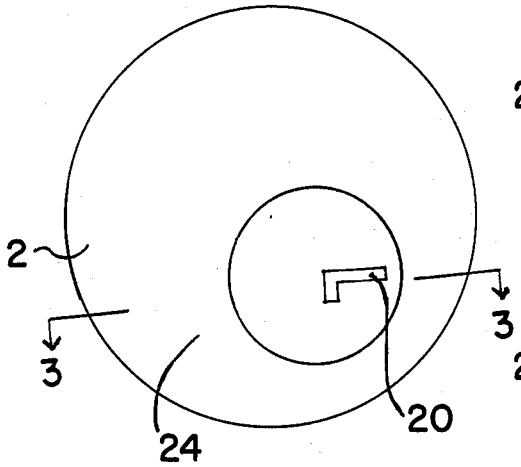
FIG. 1 shows the front face of my lock in one embodiment. The key slot is open.
Figure 2:
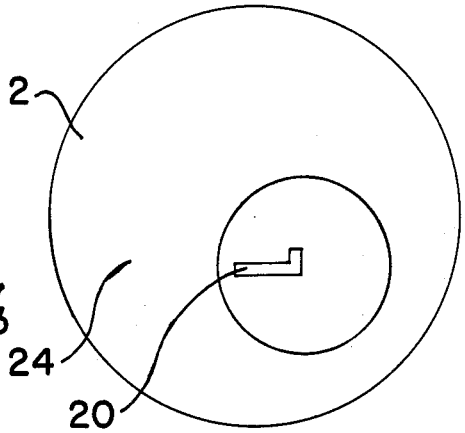
FIG. 2 shows the same face after a key has been turned counterclockwise approximately 180°. The key is not shown in FIGS. 1 and 2 for clarity.

A small cylinder 18 is provided with a keyway siot 20 and a key 22 can be inserted into this slot 20 when the cylinder 18 is in the correct initial position as shown in FIGS. 1 and 5. This is determined by the plate 24 which is fixed to the outside case 2. Thus, the key 22 can enter the lock or be removed from it in only one position.

Figure 7:
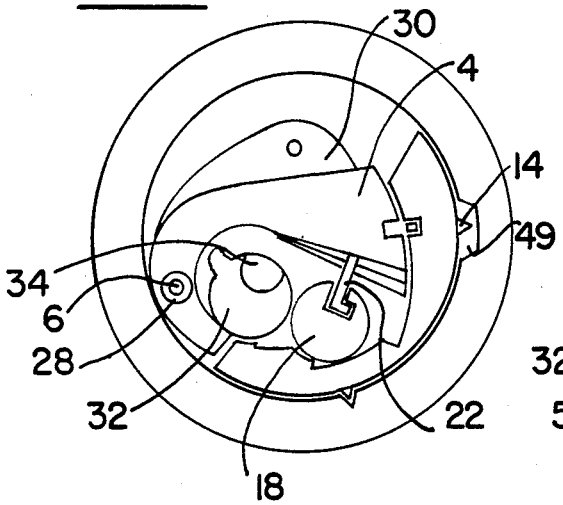
FIG. 7 shows the position of the components when the key has just set the levers.

When the key 22 is turned counterclockwise, the various raised bits 26 of the key 22 move the levers 4 as shown in FIG. 7. The levers 4 are held in position by friction resulting from the force provided by spring washer 28. The sectors are separated by fixed plates 30 so that the motion of one sector 4 is not communicated to another.

Figure 8:
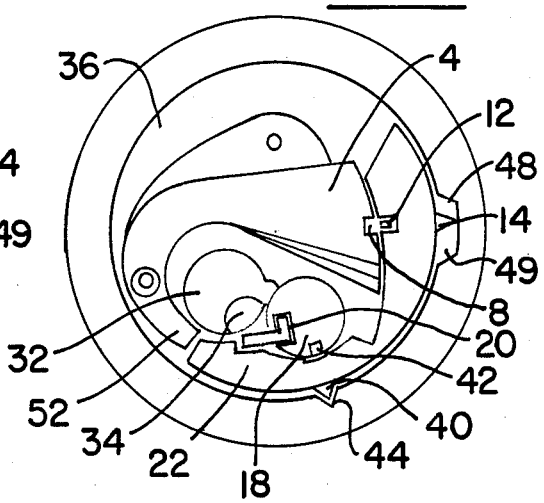
FIG. 8 shows the components with the key trapped and isolated from the levers.
Figure 9:
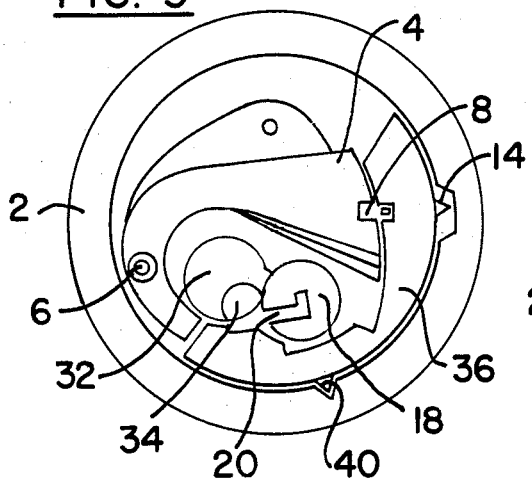
FIG. 9 shows the lock set to be unlocked but not yet turned, with no key in lock (for clarity).
Figure 10:
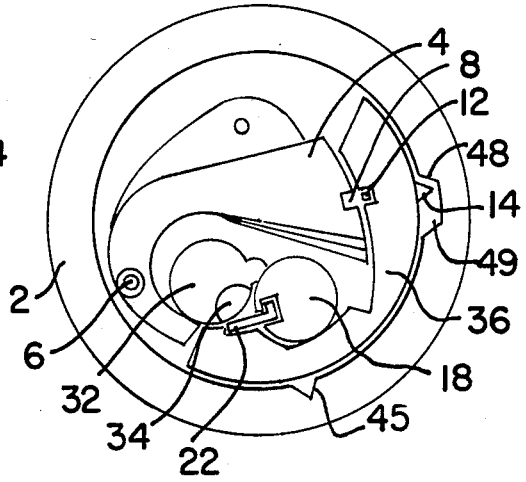
FIG. 10 shows the main lock cylinder partly turned.
Figure 11:
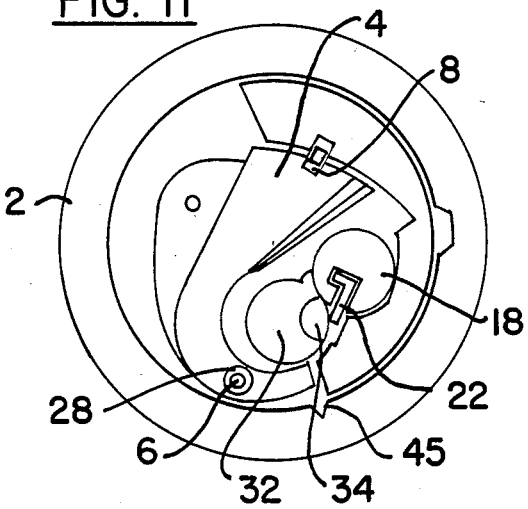
FIG. 11 shows the lock opened (main cylinder turned).
Figure 12:
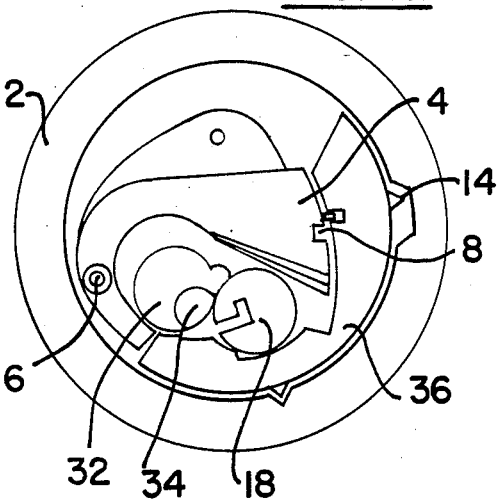
FIG. 12 shows the condition of the lock when the levers were not set correctly.

After the key 22 has set the sectors 4, it continues its counter-clockwise rotation until it reaches its final position as shown in FIG. 8.

Geared to the cylinder 18 containing the key slot 20 is another cylinder 32 (FIG. 3) which has a sector 34 cut out as shown in the FIGS. 5 to 12. It is designed so that the working portions of the key 22 can enter this cut-out section 34 as the cylinders 18 and 32 rotate with each other. In the final position shown in FIG. 8, the two cylinders 18 and 32 have rotated so as to trap the key 22 and/or its slot 20 so as to isolate them from the rest of the mechanisms in the main cylinder 36 (FIG. 8).

Formed on the outside surface of trapping cylinder 32 is a cam section 38 (FIG. 5) which serves two functions. In the position of FIG. 8 it contacts cylinder 18, thus acting to provide a better seal between space containing the key 22 and the working elements of the lock. Its second function is to reset the levers 4 as will be explained below.

After the two cylinders 18 and 32 have finished their rotation (FIG. 8) and have now trapped the key 22, a pin 40 is in position to enter the hole 42 in cylinder 18 (See FIGS. 8 and 5A). With the key 22 in this position, this pin 40 acting against the cam surface 44 as notch 45 enters hole 42 (See FIG. 5A) and permits the main cylinder 36 to turn.

Further motion of the main cylinder 36 causes the fence pin 14 to be pushed in by the cam surface 48 of the notch 49 in the outside body 2 (See FIG. 10) and to move the fence 12 into the notches 8 of the levers 4, if they had been previously correctly set. This permits the major cylinder 36 to continue to turn. If, however, the notches 4 had not been properly aligned, the fence 12 cannot enter the notches 8 of the levers 4 and the major cylinder 36 cannot be turned. It should be noted that in this position (FIGS. 8 to 12) there is no way by which any tool can reach the levers 4 to manipulate them except, of course, by drilling the lock or by other damaging means. Note that notch 49 is much wider than notch 45.

Figure 6:
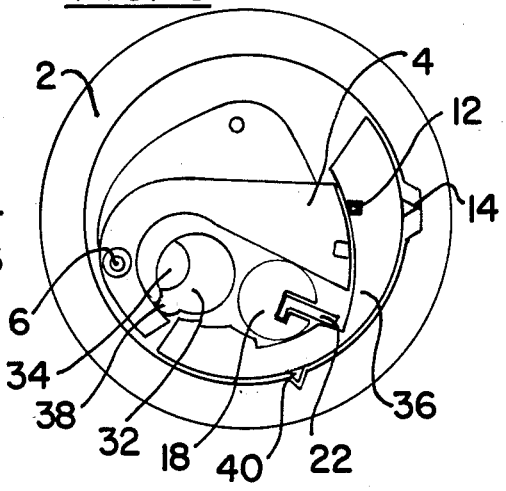
FIG. 6 shows the lock mechanism as in FIG. 5 except that the key is in the key cylinder.

When it is desired to reset the lock into its initial position, the key 22 is turned clockwise. Cylinder 36 is turned clockwise and the cam 38 operating against the ends 52 of the sectors 4 (FIG. 5) resets them all into the position shown in FIGS. 5 and 6. The key 22 finally reaches the clockwise position shown in FIG. 6 and can be removed from the lock. All this can only occur if the two pins 40 and 14 are as shown in FIGS. 5 and 6.

The number of levers 4 can be as large as desired, depending on the size of the lock and the precision of construction that can be economically achieved. For example, eight or ten levers present no special problem and each lever can have five to ten possible positions. It is obvious that with normal tolerances of key construction and other mechanical uncertainties, the number of possible positions of each element has to be kept to some reasonable value. Five or six notch positions are very easy to accomplish in an ordinary lock. If the lock is made larger, the number of possible positions can be greatly increased.

In my lock, it should be noted, that because the key 22 is removed from contact with the elements 4, the elements are held in position by friction as is done universally in combination locks. While I show levers 4 which are not balanced against the forces of gravity or shock, they can be easily arranged to be so. Each lever can be counterbalanced if the lock does not have to be crowded into the smallest possible space. Counterbalancing is particularly easy to do with the embodiment in FIG. 13. Here the only cut-outs that have to be counterbalanced are the two notches 100 and 102 and this can be easily done by putting a hole in the disk on the opposite side. I found that using a spring washer 104 or 28 (in the prior embodiment) to provide the necessary friction is much simpler and is entirely satisfactory.

If a master key is desired, some of the sectors 4 can have more than one notch 8 and this is well understood in the prior art. It should also be noted that if the fence 12 is narrow, the number of possible positions can be larger. This is also true if the fence 12 has very sharp corners and the notches 8 have equally sharp corners. Then, even a small amount of misalignment between the notches and the fence prevents the fence from entering. This action is also well understood in the art.

It is also possible to design a lock using the same basic principle explained so far but where the key instead of lifting levers, rotates disks (See FIGS. 13 to 18). This design resembles the internal construction of a typical combination lock. There are two obvious methods of doing this. One is to gear each lever 4 of the lock of my first embodiment (FIGS. 5 to 12) to a disk so that moving the lever rotates the disk. This may be an advantage in that a relatively small motion to the lever can produce a large motion of the disk so as to spread the fence entering notches over a large circumference. The same thing can be done, of course, by making the levers very large, but the overall size of the lock is often an important consideration.

Figure 14:
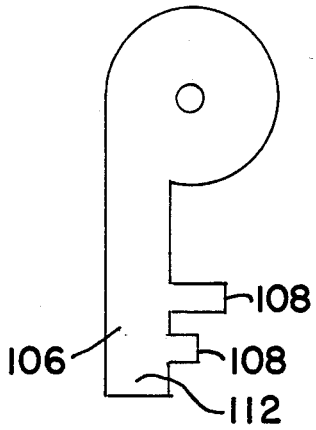
FIG. 14 shows a key to cooperate with a lock in FIG. 13.
Figure 15:
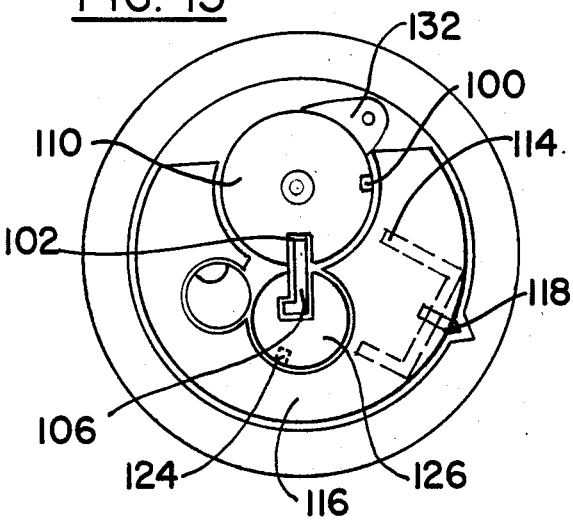
FIG. 15 is the same as FIG. 13 except that the key is in its cylinder.
Figure 16:
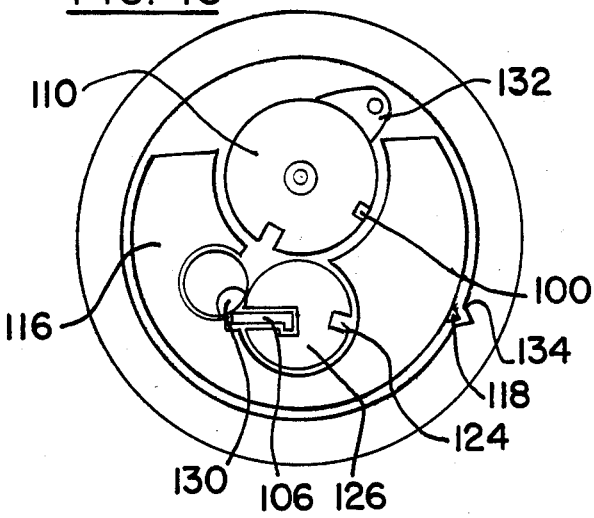
FIG. 16 shows the key trapped and isolated from the disks, after the disks have been properly set by the key.

A method of making a key turn disks directly is shown in FIGS. 15 and 16. Here the key 106 has raised portions, or bits, 108 of various heights and the key 106 can enter suitable notches 102 in the disks 110, and as the key 106 (FIG. 15) turns, each disk 110 is moved through an appropriate angle. A high bit 108 moves the disk through a large angle, and a lower bit 108 moves a disk 110 through a smaller angle, and where there is no raised key section 112, the disk 110 stands still. The key shown in FIG. 14 is therefore of three bit heights, 0, 1 and 2, as shown.

Each disk 110 is provided with a notch 100 into which a fence 114 can enter. With the exception of resetting the disks 110 which, in this case, is done by the key itself, the operation of the lock is similar to that of FIGS. 5 to 12.

In the embodiment of FIGS. 13 to 18, I show a different arrangement of pin interlocks to assure that the key 106 is trapped and isolated from discs 110 before the lock cylinder 116 can be turned. The pin 118 is bifurcated into two arms 120 and 122. Arm 120 is designed to enter hole 124 as the key 106 starts to turn the cylinder 126 counterclockwise to open the lock. Arm 122 is terminated in fence 114.

The lengths of the two arms 120 and 122 are so proportioned that arm 120 is closer to the cylinder 126 than fence 114, at the end of arm 122, is to the disks 110. This is done so that the arm 120 must enter hole 124 before the fence 114 can determine whether the discs 110 were set correctly. Thus the key 106 must turn the cylinder 126 to the position shown in FIG. 16 before the fence 114 can cause the lock to open. In this position (FIG. 16) the key is isolated from the lock opening mechanism as was done in the prior-described embodiment. Here, again, two cylinders 126 and 128 are geared together. Cylinder 128 has a sector 130 cut out so as to form part of the isolation chamber for the key 106.

As in the previous embodiment, separator plates 132 are located between the discs 110 so that turning one disc does not move another.

If the discs 110 were set correctly by the key 106, the fence 114 enters the notches 100 and the inner cylinder 116 can rotate, being no longer prevented from doing so by the pointed pin 118.

Figure 13:
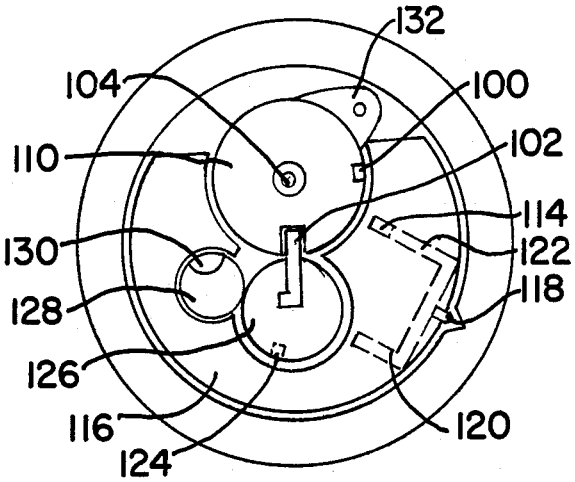
FIG. 13 shows a different embodiment of my lock which is similar to that of FIG. 5 except that instead of levers, I now have three disks set by the key.

When the lock cylinder 116 is rotated back to its initial position, pin 118 moves back into notch 134 (FIG. 16). This retracts arms 120 and 122 and the fence 114. The key cylinder 126 is now free to rotate and the key can reset discs 110 into their initial positions as shown in FIGS. 13 and 15.

Figure 17:
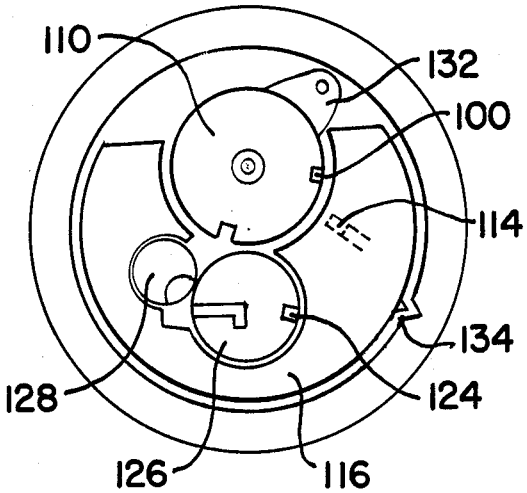
FIG. 17 is the same as FIG. 16 with the key not in its cylinder.

FIG. 17 shows the positions of the lock components if a pick is used to turn the cylinders 126 and 128 into the positions shown. The arm 120 can enter the hole 124 in cylinder 126, but the fence 114 cannot enter the notches in the incorrectly set discs. In this configuration, there is no physical path available to the pick to reach the discs from outside the lock.

Figure 18:
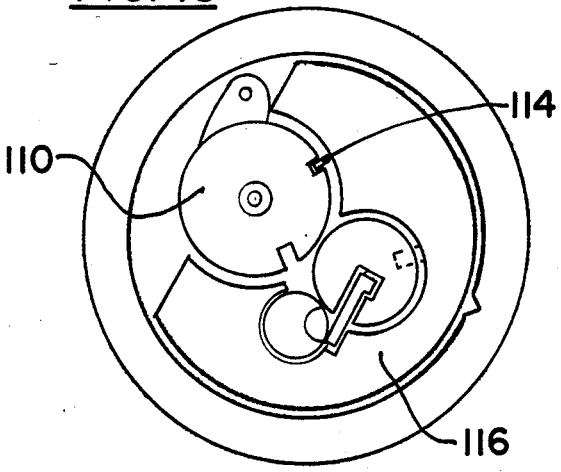
FIG. 18 shows the lock after it has been unlocked. (The main cylinder has been turned).

FIG. 18 shows the lock after it has been unlocked by a proper key.

It should be noted that in the case of a lock where elements are set by a key which then, in effect, is removed from further cooperation with the lock, the lock can be considered to be a combination lock. The action of a fence entering levers or disks in my lock is not different from that which occurs in a conventional combination lock. It is no easier to test the position of the levers or discs of my lock than it would be to test the position of disks in a conventional combination lock. As a matter of fact, because a key can set a much larger number of elements than a dial, such a key lock offers greater protection against surreptitious tampering than the conventional combination lock. A naive question arises as to why not use many more disks in a conventional combination lock. The difficulty with such approach is that when a conventional lock has more than three disks, the setting becomes very difficult. With ten disks, one would have to spin all of the disks first in one direction and then set the first number, then rotate the setting dial in the other direction nine times, set another number, then rotate the dial eight times, etc., etc. This is very difficult to do without mistakes and as far as I know this is never done. With a key setting the disks, however, there is no problem of having ten discs or levers, or any other number.

In a combination lock, it is sometimes possible to detect the differences in height among the three disks. The problem becomes very difficult if one tries to do that with ten levers or other such elements. Because these levers can be stamped out by a single die, there is no problem of making them identical. This is much easier than turning disks to the same exact diameter as by a lathe. This last consideration I do not consider very important technically, but it is a factor in considering the cost of locks.

Another embodiment is shown in FIGS. 19 to 24. Its settable elements 200, which can be conventional levers, are set by a key 202 as before, but instead of the key 202 being isolated from the levers 200 by a trapping mechanism, the isolation is accomplished by removing the key 202 from the lock entirely and then closing the key slot 204 completely before any attempt can be made to test whether the levers 200 (or other elements) have been set correctly.

Figure 22:
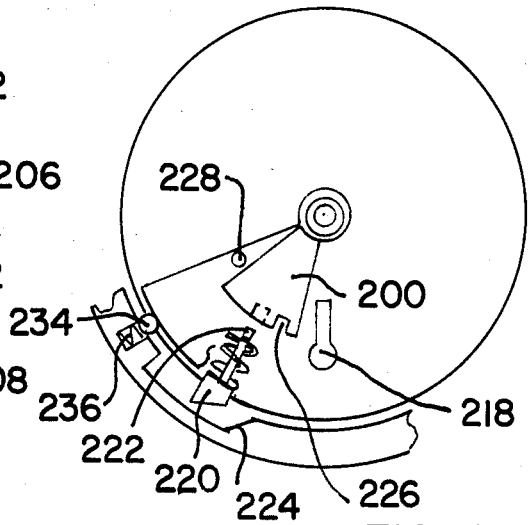
FIG. 22 shows the main features of the inside of the lock taken as a section roughly along line 22 of FIG. 21.
Figure 23:
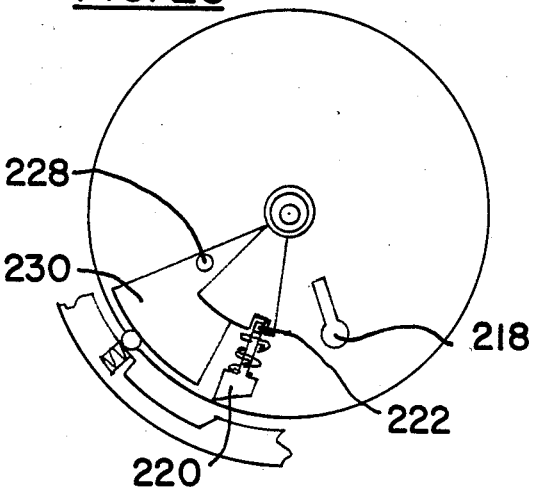
FIG. 23 shows the mechanism after the levers had been set correctly and the inner cylinder has been rotated counterclockwise. The lock is now unlocked.

To accomplish this, I show in FIGS. 19 to 24 a lock having an outside rigid case 206, an inner rotatable cylinder 208 whose top 210 is fitted closely to the upper plate 212 of the case 206. I show a space between them in FIG. 21 for clarity only. The inner cylinder 208 has a shaft 214 protruding through the top 212 of the lock. A knob 216 mounted on the shaft 214 provides the means by which the inner cylinder 208 can be rotated. FIG. 22 is taken roughly along plane 22—22 of FIG. 21.

Figure 20:
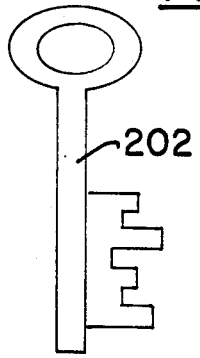
FIG. 20 shows the key designed for this lock.
Figure 21:
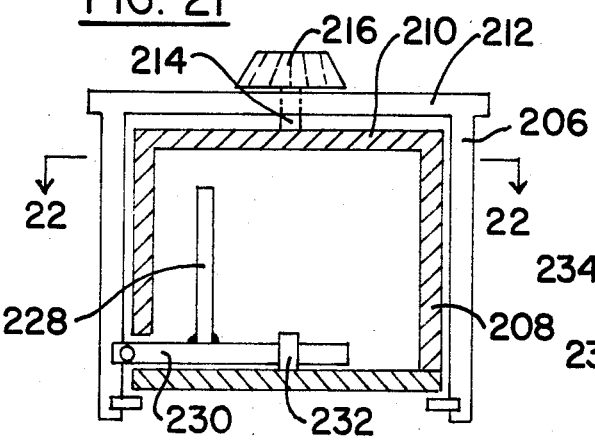
FIG. 21 shows a cross-section taken roughly parallel to the main axis of the lock cylinder.

In the initial condition (FIG. 22) the key slot 204 in the top 212 of case 206 is aligned with a similar key slot 218 in the inner cylinder's top plate 210. Thus, when the two slots are aligned, the key 202 such as shown in FIG. 20, can be inserted into the lock. It is then turned counterclockwise (viewed from above) approximately 45° to set the levers 200.

Figure 19:
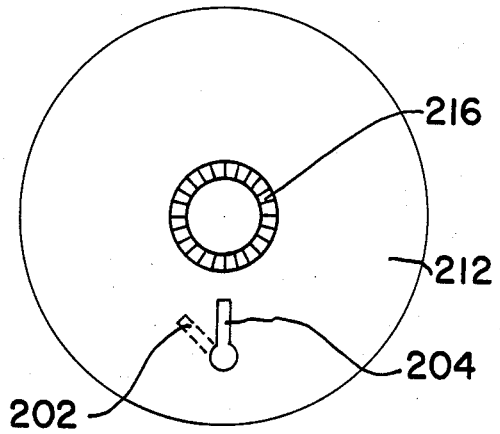
FIG. 19 shows a different embodiment of my lock, front view. The dotted line shows the position of the key as it sets the levers.
Figure 24:
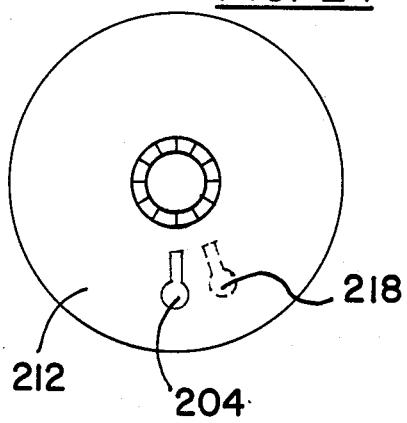
FIG. 24 shows the relative positions of the key slots in the outer case of the lock and in the top surface of inner cylinder.

The key 202 after setting the levers 200 is shown by dotted lines in FIG. 19. The inner cylinder 208, of course, cannot be turned by the knob 216 because the key itself prevents this. For the lock to be opened, the key 202 has to be removed entirely. The lock cylinder 208 cannot be turned clockwise because of the shape of the spring pin 220, (See FIG. 22). The knob 216, however, can be turned counterclockwise. This automatically closes the key slot 218 because the two slots 204 and 218 are no longer aligned. The new position of the slot 218 in the inner cylinder is as shown in FIG. 24. If the levers 200 had been set correctly, a fence 222 operated by the pin 220 acted upon by cam surface 224, enters the notches 226 in the levers 200, as in FIG. 23. The inner cylinder 208 can now continue turning counterclockwise. It can then operate the rest of a conventional lock mechanism that need not be shown here.

When it is desired to close the lock, the knob 216 is turned clockwise but before the key slots 204 and 218 become aligned, pin 220 passes down the cam surface 224, fence 222 is withdrawn from the lever notches 226 and the levers 200 can now be reset. This is done by a vertical rod 228 seen in FIGS. 21, 22 and 23. It is mounted on plate 230 pivoted at pin 232 mounted on and concentric with the inner cylinder 208. A ball detent 234 operated by a spring 236 mounted in the outer, stationary body cylinder of the lock 206 presses against the plate 230 so that as the inner cylinder 208 is rotated clockwise the plate 230 is held back by friction because of the detent 234. The rod 228 acts to reset all the levers 200 back to their initial position before the two key slots 204 and 218 are aligned. The lock now is ready for another operation.

In order to increase the friction between the detent 234 and the plate 230 the plate can have a serrated edge and the ball detent can be replaced by a pointed pin to increase the forces between them. The embodiment shown is by way of an example only and ratchets of various types are well known to the art so that the plate 230 can be held back as the inner cylinder is rotated clockwise (looking from above).

Figure 25:
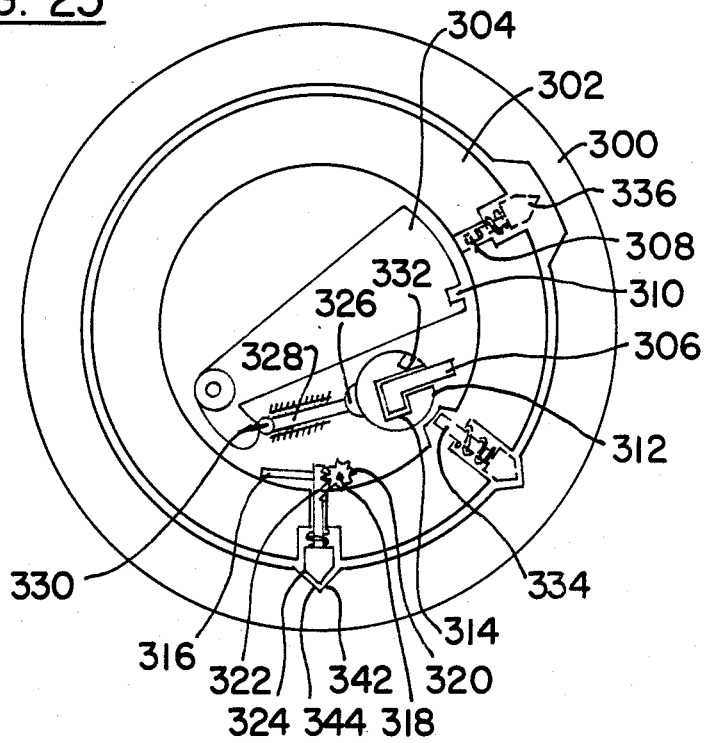
FIG. 25 shows a different embodiment of my lock. It is similar to that shown in FIGS. 1 to 12. The lock is shown in section as it is in the locked condition.
Figure 26:
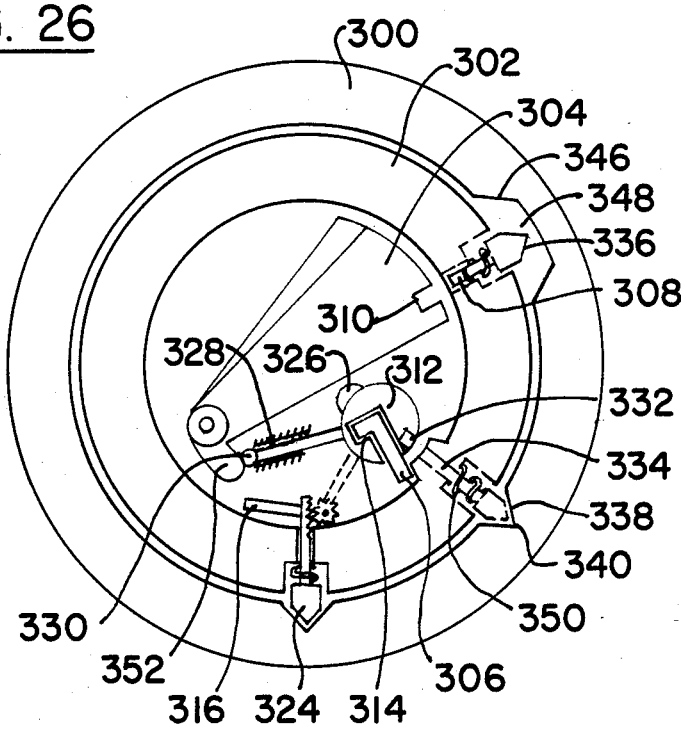
FIG. 26 is a section view showing the lock after it has been unlocked by a proper key.

FIGS. 25 and 26 show still another embodiment of my invention. The design is similar to the first embodiment, as shown in FIGS. 1 to 12, and the drawings are simplified schematics taken just below the front plate of the lock as was done in FIG. 5.

The lock has an outside body cylinder 300 and an inner cylinder 302. To open the lock the inner cylinder 302 must be rotated. This is identical in operation with a great many locks used throughout the world.

Mounted inside cylinder 302 are a set of levers 304 that must be correctly set by a key 306 so that a fence 308 should be able to enter notches 310 in these sectors 304.

Figure 3:
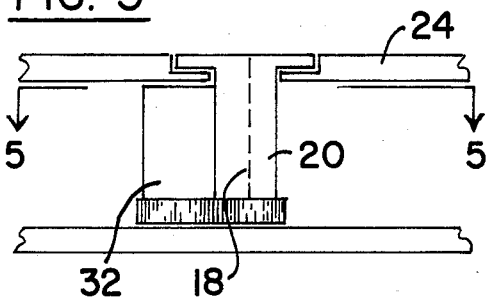
FIG. 3 shows a section taken approximately on line 3—3 of FIG. 1. This figure shows a simplified form of the two co-acting cylinders, one for holding a key and the second acting to isolate it from the rest of the lock under certain conditions.
Figure 4:
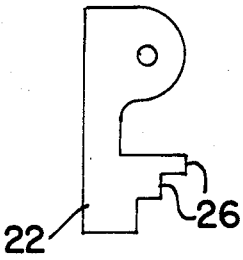
FIG. 4 shows a key cut to set three levers.

A key cylinder 312 is located in the inner cylinder 302, and is provided with a key slot 314. The key 306 that can be identical to key 22 as shown in FIG. 4, can be inserted through a suitable key opening 20 in the top plate 24 of the lock as shown in FIGS. 1 and 3.

Unlike the lock of FIGS. 3 to 12, this last embodiment does not contain a second cylinder (32 of FIGS. 3 and 5) to isolate the key 306 after it has set the sectors 304. Instead, I use a swinging plate 316 pivoted on shaft 318. The plate 316 is driven by a small diameter pinion gear 320 affixed to shaft 318. This gear 320 is acted upon by a short rack 322 that is a part of pin 324.

The resetting of the levers 304 is accomplished in a manner somewhat similar to that of the first embodiment (FIGS. 3 to 12), except that the key cylinder 312 itself has a cam 326 at its lower end for this purpose. The cam 326 acts on a sliding pin 328 mounted for lengthwise movement in the base of the cylinder 302. A vertical rod 330 is fastened to the pin 328 at its left end as seen in FIGS. 25 and 26, and this vertical rod 330 resets the levers 304 when the key cylinder is rotated clockwise to its initial position as seen in FIG. 25.

The key cylinder 312 is provided with a small hole 332 into which pin 334 must enter before the lock can be opened.

The action of the fence-pin 336 and of the fence 308 are exactly as described for the pin 14 and fence 12 in the first embodiment.

For this lock to be opened, a proper key 306 is inserted into the key slot 314 in the key cylinder 312. The key 306 is turned counterclockwise about 300 degrees till it is stopped by the solid parts of the inner cylinder 302 as shown in FIG. 26.

The pin 334 acted on by the cam surface 338 of the notch 340 (in the outer case 300) moves into the hole 332 of the key cylinder 312, and the rack 322, acted on by the cam surface 342 of the notch 344 swings the plate 316 into the position shown in dotted lines in FIG. 26.

The inner cylinder 302 is now free to continue rotation. The fence pin 336 reaches the cam surface 346 of the wide notch 348 in the outer case 300, and because the sectors 304 had been correctly set, as stated, the fence 308 enters the notches 310 and the lock can be opened.

It can be noted that in this embodiment for the lock to open the path from the key slot 314 to the sectors 304 is very long and torturous so that even if the isolation plate 316 were somehow to fail in its function, picking the lock would be extremely difficult.

When the cylinder 312 is returned to its original position, as shown in FIG. 26, the pin 334 is withdrawn from the hole 332 by its spring 350 and the key 306 can now be turned clockwise to the position shown in FIG. 25 so that it can be withdrawn from the lock. As the key 306 is turned clockwise, the cam 326 acts on the sliding pin 328, and the rod 330 acting on the ends 352 of the sectors 304 resets them to their normal, unlocked positions, as shown in FIG. 25.

Another consideration in the design of my invention is that the levers are held in position by friction and do not need springs as used in almost all conventional lever locks. This is an important consideration in designing locks for low price and high reliability.

I claim to have invented:

1. In a lock and key combination, locking means comprising first and second members movable with respect to each other in order to unlock the lock, a plurality of movable devices which if set in predetermined positions, respectively, permit the lock to be opened, a key for setting said devices in said predetermined positions respectively, said lock having key receiving means to permit entry of only a portion of said key, whereby a portion of the key projects out of the lock, blocking means for blocking movement of said members relative to each other when said movable devices are not in said predetermined positions, and which does not block relative movement of said members when said movable devices are in said predetermined positions respectively, said last-named means allowing the correctness of the settings of the movable devices to be tested by attempting to move one of said members a sufficient distance relative to the other to see if said last-named means is blocking the movement of one said members relative to the other one, whereby said key may operate said lock to perform a normal lock-opening operation, and movable means, operable during the normal lock-opening operation, for moving into the path of, and for blocking the passage of, any lock-picking tool that may enter said key receiving means, and before such tool can advance to said devices.

2. In a lock and key combination as defined in claim 1, said movable means comprising means separate from and in addition to said key, said devices and said blocking means.

3. In a lock and key combination as defined in claim 1, said blocking means including means for blocking the aforesaid testing of the correctness of said settings, irrespective of the respective settings of said devices, except when said movable means is in said path and would block any passage of a lock-picking tool from said keyhole to said devices.

4. In a lock and key combination as defined in claim 1, said movable means comprising an element that has a second keyhole aligned with said first-named keyhole when the lock is locked, said element being connected to one of said members and movable therewith to take said second keyhole out of alignment with the first-named keyhole and interpose a portion of said element in said path to thus block the passage of any lockpicking tool when there is relative movement of said members as part of a normal unlocking of the lock.

5. In a lock and key combination as defined in claim 1, said key-receiving means being mounted for rotation, and having means for receiving said key and being rotated thereby, and also defining a hole therein, said blocking means including a blocking element that blocks relative movement of said members except when said element is in said hole, said key-receiving means being rotated by said key to permit said element to enter said hole, said movable means being rotated by said key-receiving means for blocking said path to prevent passage of a lock-picking tool to said devices when said element is in said hole.

6. In a lock and key combination, lock means including first and second members movable relative to each other to unlock the lock, key-receiving rotatable means for receiving said key and being rotated thereby, from first to second angular positions, to unlock the lock, blocking means for preventing relative movement of said members, said blocking means including means for preventing said relative movement of said members except when said key receiving rotatable means is in said second angular position;

a plurality of devices settable by said key, when it is moved from said first to said second angular position, to predetermined positions respectively, said blocking means including means for preventing said relative movement of said members except when said devices are in said predetermined positions respectively, and preventing means, which when said rotatable means is in said second angular position, prevents a picking tool, inserted into said rotatable means in place of the key, from setting said devices in said predetermined positions.

7. In a lock and key combination as defined in claim 6, said second member having two indents therein, said blocking means comprising two separate arms, one such arm for each said indent, each of said arms being mounted on said first member and entering its complementary indent when the lock is locked, said rotatable means defining an opening for receiving one of said arms when the rotatable means is in said second angular position, said devices, when in said predetermined positions respectively, defining an opening for receiving the other one of said arms.

8. In a lock and key combination as defined in claim 7, and means for moving said arms from said second member when said rotatable means is in said second angular position.

9. In a lock and key combination as defined in claim 6, said second member having an indent therein, said rotatable means having an opening therein, said devices when set in said predetermined positions defining an opening, a third member carried by said first member, having first, second and third arms, said first arm being positioned in said indent when said lock is locked, and said second and third arms being positioned to enter said openings respectively and allowing the withdrawal of the first arm from said indent when said rotatable means is in said second angular position.

10. In a lock and key combination as defined in claim 9, means for moving said first arm away from said indent when said rotatable means is in said second angular position.

11. In the lock and key combination of claim 10, said means for moving said first arm comprising an inclined surface constituting a sidewall at one end of said indent.

12. In the lock and key combination of claim 6, movable means for moving said preventing means when the key is rotated to unlock the lock, into a position where it blocks any picking tool that enters the keyhole, in place of the key, from reaching said devices.

13. In the lock and key combination of claim 12, said movable means including cam means for resetting said devices to their locked positions when the rotatable means is rotated from said second to said first angular position.

14. In the lock and key combination of claim 6, said first and second members comprising first and second concentric cylinders respectively with the second cylinder being outside of the first one, said key having a plurality of projections, one such projection for each said device, means for pivotally mounting said devices on said first cylinder so that each said device will be moved to its predetermined position by its complementary projection on the key, when the key is rotated to move said rotatable means from its first to its second angular position, said devices forming an opening when they are in said predetermined positions respectively, said rotatable means defining an additional opening therein, said second cylinder having an inner wall and said first cylinder having an outer wall facing said inner wall, first and second indents in said inner wall, a first arm having one end in said first indent when the lock is locked, to prevent the cylinders from having the relative motion required to unlock said lock, said first arm being movable into said opening that is formed by said devices when the lock is unlocked, a second arm having one end in said second indent, when said rotatable means is not in said second angular position, to prevent the cylinders from having the relative motion required to unlock the lock, said second arm being movable into said opening in said rotatable means when said rotatable means is in said second angular position, said preventing means comprising a rotatable element adjacent to and connected to said key-receiving rotatable means for rotation thereby, said rotatable element comprising a sector of a cylinder rotatable about its axis, said key-receiving rotatable means having an axis of rotation parallel to said axis of rotation of said sector, said sector rotating to a position in engagement with said key-receiving rotatable means when said key-receiving rotatable means is in said second angular position, so that passage of a lock-picking tool, inserted in said rotatable means in place of said key is prevented from setting said devices.

15. In the lock and key combination of claim 14, cam means on said rotatable element for resetting said devices to a locked position when said rotatable means is rotated from said second to said first angular position whereby to lock the lock.

16. In the lock and key combination of claim 6, said first and second members comprising first and second concentric cylinders respectively with the second cylinder being outside of the first one, said key having a plurality of projections, one such projection for each said device, means for pivotally mounting said device for rotation, each device having a periphery and an indent in its periphery shaped to receive the projection on said key complementary to said device and also shaped so that the angular distance that the device is rotated by said key depends on the height of the projection complementary to the device, said devices forming an opening therein when rotated by the key to said predetermined positions respectively, said key-receiving rotatable means having an opening therein, said second cylinder having an inner wall facing the first cylinder, said inner wall of said second cylinder having an indent therein, said blocking means having first, second and third arms joined together in a fixed relationship, said arms being mounted on and supported by said first cylinder, said third arm entering said indent when the lock is locked to thus block relative movement of said cylinders, said first and second arms entering said openings respectively and said third arm moving out of said indent when the lock is unlocked.

17. In the lock and key combination of claim 16, said projections on said key engaging their complementary devices to reset the devices to locked positions when the key is rotated from said second to said first angular position.

18. In the lock and key combination of claim 16, said preventing means comprising a rotatable element in the form of a sector of a cylinder having an axis and rotatable about said axis, said key-receiving rotatable means having an axis parallel to the axis of the said sector, said sector being connected to said key-receiving rotatable means and rotated thereby so that said sector is rotated into contact with said key-receiving rotatable means when said key-receiving rotatable means is in said second angular position, to thereby prevent a picking tool entering said key-receiving rotatable means in place of a key, from reaching said devices when the key-receiving rotatable means is in said second angular position.

19. In a lock and key combination, inner and outer concentric cylinders, mounted for relative angular rotation to unlock the lock, key-receiving rotatable means mounted for angular movement from a first angular position to a second angular position, a plurality of devices respectively settable into predetermined positions for unlocking the lock, a key, only a portion of which is capable of being insertable in said key-receiving rotatable means, said key having means for moving into contact with said devices to set them into said predetermined positions respectively and then movable past said devices and out of contact with them as the key-receiving rotatable means moves to said second angular position, and blocking means for blocking relative angular rotation of said cylinders until said key-receiving rotatable means has been moved to said second angular position and said devices are in said predetermined positions respectively.

20. In a lock and key combination as defined in claim 19:

said key-receiving rotatable means requiring a movement of over 180 degrees to go from said first angular position to said second angular position.

21. In a lock and key combination as defined in claim 20:

means actuated by an attempt to open the lock for blocking the path of a lock-picking tool to said devices.

22. In the lock and key combination of claim 1:

said movable means including means for moving at least a part of the movable means into said path in response to relative movement of said movable members.

23. In a lock and key combination as defined in claim 1:

said key receiving means having a keyhole at the entrance thereto, said movable means comprising closure means for closing the entry to said key-receiving means past said keyhole.

* * * * *